US005259588A

United States Patent [19]

Crosby, Jr. et al.

[11] Patent Number: 5,259,588

[45] Date of Patent: Nov. 9, 1993

[54] DRAIN VALVE

[75] Inventors: Odessa D. Crosby, Jr., Pleasanthill, Mo.; George K. Crosby; John J. McGeough, Jr., both of Carrollton, Tex.

[73] Assignee: Alpha Omega, Inc., Waycross, Ga.

[21] Appl. No.: 774,999

[22] Filed: Oct. 11, 1991

[51] Int. Cl.[5] ..... F16K 31/60; F16K 35/00; F16K 3/24; F16K 3/28

[52] U.S. Cl. ..... 251/100; 184/1.5; 222/110; 251/324

[58] Field of Search ..... 251/95, 100, 215, 218, 251/319, 324, 325; 184/115; 222/108, 110; 137/312

[56] References Cited

U.S. PATENT DOCUMENTS

| | | | |
|---|---|---|---|
| 223,886 | 1/1880 | Conklin | 251/100 |
| 2,095,696 | 10/1937 | Hackel | 184/1.5 |
| 2,152,831 | 4/1939 | Williams | 251/324 |
| 2,916,044 | 12/1959 | Phelan et al. | 251/100 |
| 3,255,938 | 6/1966 | Dimmich et al. | 251/324 |
| 3,477,687 | 11/1969 | Doutt | 251/324 |
| 3,490,736 | 1/1970 | Snyder | 251/215 |
| 3,507,475 | 4/1970 | Davis et al. | 251/324 |
| 3,727,638 | 4/1973 | Zaremba et al. | 184/1.5 |
| 4,078,763 | 3/1978 | Yamamoto | 137/315 |
| 4,503,934 | 3/1985 | Stephanus et al. | 251/215 |

FOREIGN PATENT DOCUMENTS

| | | | |
|---|---|---|---|
| 563064 | 6/1958 | Belgium | 251/324 |
| 302006 | 10/1932 | Italy | 251/100 |
| 561441 | 5/1944 | United Kingdom | 251/100 |

*Primary Examiner*—George L. Walton

*Attorney, Agent, or Firm*—W. Kirk McCord; Daniel V. Thompson

[57] ABSTRACT

A drain valve includes a valve body, inlet and outlet ports, a first bore communicating between the inlet and outlet ports and a second bore intersecting the first bore at a right angle. A slidable member is mounted for reciprocal movement within the second bore. The slidable member includes a pin comprised of a resilient composite material, such as virgin tetrafluoroethylene, which maintains its resiliency throughout a wide range of temperatures and pressures. The diameter of the pin is slightly greater than the diameter of the second bore. As such, the pin is compressible to allow the pin to be inserted into the second bore and is expandable against inner surfaces of the valve body defining the first and second bores to provide a positive seal along substantially the entire length of the pin. An effective seal is maintained, despite variations in temperatures and pressures, to prevent leakage and accidental movement of the slidable member. A slot is cut in the pin to function as a guide slot. The valve body includes a retaining pin, which extends into the slot to define the limits of reciprocating movement of the pin. The drain valve according to the present invention is particularly well-suited for use as oil pan plug valve for controlling the drainage of oil from an automobile oil pan. The valve mechanism is operable without the use of tools to allow oil to be drained from the pan without splattering or spillage.

20 Claims, 2 Drawing Sheets

DRAIN VALVE

FIELD OF INVENTION

This invention relates generally to drain valves and in particular to an improved drain valve adaptable for use as an oil pan plug valve.

1. Background of the Invention

Drain valves are used in a variety of applications and systems for draining fluid from a flow line or reservoir. For example, automobile oil pans are usually equipped with drain plugs for draining lubricating oil from the pan.

Generally, for proper maintenance of an engine, including an automobile engine, lubricating oil must be changed periodically. For this purpose, a drain port is typically provided in the oil pan or lubricating reservoir for being sealably closed by a threaded plug which engages complementary threads in the drain port. When the plug is removed, oil is drained from the pan by gravity. A container having a wide mouth is required to capture the oil being drained from the oil pan. The oil must then be poured into a permanent container and transported to a facility for recycling or other disposition.

If the plug is removed by an unskilled or inexperienced person, the oil may spill or splatter on the person, thereby resulting in environmental pollution and at the very least a messy condition requiring extensive cleanup. Further, serious injury has occurred to persons attempting to drain hot motor oil, either from direct contact with the hot oil or from contact with hot metal plugs or oil pans. Injuries may also result from slippage in spilled motor oil. Besides environmental pollution, health problems may result from contact with highly concentrated lead particles and other contaminants suspended in the oil.

Because of the aforementioned problems, many automobile owners utilize service stations and other repair facilities for engine oil changes. However, oil changes at a service facility are relatively expensive and it is often inconvenient to bring the automobile to a repair facility, particularly when an oil change is the only maintenance required.

2. Description of the Prior Art

Various attempts have been made to overcome the aforementioned problems. Such attempts have usually involved modifying the drain plug to form a combined drain valve/plug, as shown in U.S. Pat. Nos. 2,095,696; 3,727,638; and 4,078,763. Such valves are prone to leakage due to the corrosive nature of lubricating oil and the temperature extremes associated with the operation of an automobile engine. Furthermore, prior art drain valves are susceptible to accidental manipulation due to impact forces and vibration, which may result in the accidental discharge of lubricating oil, thereby causing engine damage as well as environmental pollution.

There is therefore a need for a reliable drain valve which is adaptable for use as an oil plug valve. There is also a need for an improved drain valve to allow an automobile owner to change automobile lubricating oil without the hazards, inconvenience and mess normally associated with the oil change procedure.

DISCLOSURE OF THE INVENTION

In accordance with the present invention, a fluid drain valve is comprised of a valve body having an inlet port through which fluid is admitted into the valve body and an outlet port through which fluid is drained from the valve body; first and second bores extending at least partially through the valve body, the second body intersecting the first bore at essentially a right angle; and a slidable member mounted for reciprocating movement in the second bore between a first position at which the inlet and outlet ports are in fluid communication and a second position at which fluid communication between the inlet and outlet ports is substantially blocked. In accordance with a unique feature of the invention, the slidable member is compressible to allow the slidable member to be inserted into the second bore and is expandable within the second bore to provide a positive seal between the slidable member and an inner surface of the valve body defining the second bore along substantially the entire length of the slidable member. In accordance with another unique feature of the invention, the slidable member is further expandable into a portion of the first bore adjacent an intersection of the second bore with the first bore, to provide a positive seal between the slidable member and an inner surface of the valve body defining the first bore.

In accordance with yet another feature of the invention, the slidable member has a slot extending along a longitudinal axis of the slidable member. The slot defines first and second shoulders at respective opposed ends of the slot. The valve body further includes a guide pin normally in mating relationship with the slot for guiding the reciprocating movement of the slidable member. The guide pin cooperates with the first and second shoulders to define the first and second positions. In one embodiment, the slidable member further includes an arcuate groove communicating with the slot and extending transversely with respect to the longitudinal axis of the slidable member. The guide pin is aligned with the groove when the slidable member is in the second position. The guide pin is captured within the groove by rotating the slidable member about its own axis to retain the slidable member in the second position.

In accordance with a further feature of the invention, the first bore extends between the inlet and outlet ports. The second bore passes transversely through the first bore and terminates within the valve body. The slidable member further includes a passage communicating between a leading end of the slidable member and the first bore when the slidable member is in the second position to relieve fluid from the second bore into the first bore. In one embodiment, the passage is comprised of a slot extending from the leading end of the slidable member, partially along the longitudinal axis of the slidable member. In another embodiment, the passage extends from the leading end of the slidable member, diagonally through a portion of the slidable member, and communicates with the first bore.

In the preferred embodiment, the slidable member is comprised of a substantially cylindrical pin made of a resilient material, the resiliency of which is substantially stable throughout a predetermined range of temperatures corresponding to a range of temperatures to which automobile engine lubricating oil is normally subjected. The material is also preferably corrosion resistant and self-lubricating. For example, virgin polytetrafluoroethylene has been found to be a suitable material for the pin. The slidable member further includes a cap having a recess for receiving a trailing end of the pin in mating relationship. The cap provides a gripping surface for manual operation of the pin. The first and second bores are preferably cylindrical bores, with the diameter of the first bore being no greater than 80% of the diameter of the second bore. The diameter of the pin is somewhat greater than the diameter of the second bore, such that the pin is compressed when the pin is inserted into the second bore. A leading end of the pin is tapered to provide relief for compression of the pin.

The drain valve is preferably a plug valve adapted for use in automobile oil pan drain port. The valve includes a plug member machined in relief from the valve body and having external screw threads adapted to engage complementary internal threads in the oil pan drain port. A nipple member is machined in relief from the valve body on an opposite end of the valve body from the plug member. The nipple member is adapted to be received in mating relationship with a conduit for conducting oil drained from the oil pan to a selected location.

BRIEF DESCRIPTION OF THE DRAWINGS

FIG.'s 1A-1C are respective longitudinal sectional views of a drain valve, according to the present invention, showing the drain valve in the open, closed, and closed and locked positions, respectively.

DETAILED DESCRIPTION OF THE PREFERRED EMBODIMENT

Figure 1A:
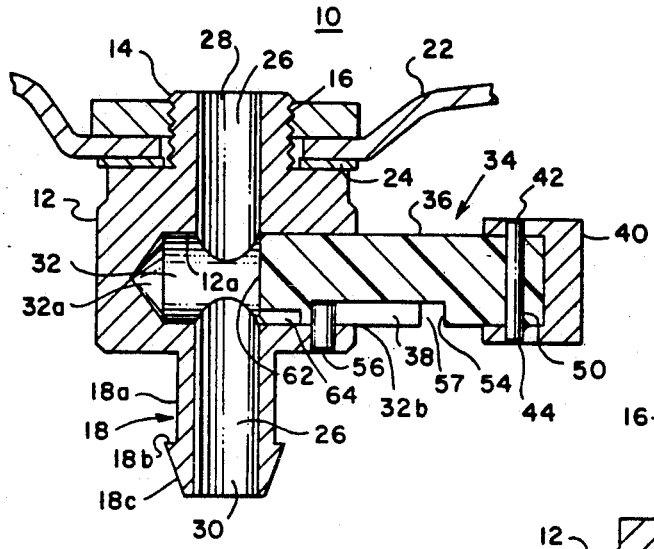

In the description which follows, like parts are marked throughout the specification and drawings with the same respective reference numerals. The drawings are not necessarily to scale and in some instances proportions may have been exaggerated in order to more clearly depict certain features of the invention.

Referring to FIG.'s 1A-1C, a plug valve 10 of the 180° or "straight through" configuration is comprised of a valve body 12, a plug member 14 having external threads 16 cut in relief and a nipple member 18. Plug member 14 and nipple member 18 are integrally formed with valve body 12 and are machined in relief therefrom. Threads 16 are adapted for threaded engagement with complementary threads of a drain port formed in automobile oil pan 22, as can be best seen in FIG. 1A. An annular washer 24 is positionable in concentric relationship with plug member 14 for being positioned intermediate oil pan 22 and valve body 12, as shown in FIG. 1A. Washer 24 prevents direct metal-to-metal contact between oil pan 22 and valve body 12. Valve body 12 is machined from hexagon metal bar stock, such as aluminum or brass bar stock.

A first cylindrical bore 26 extends through plug member 14, valve body 12 and tubular member 18. Bore 26 communicates between an inlet port 28 and an outlet port 30. A second cylindrical bore 32 is machined in valve body 12. Bore 32 intersects and passes through bore 26, substantially at a right angle with respect to bore 26. Bore 32 does not pass completely through valve body 12, but rather terminates in a constricted portion **32*a*** corresponding to the shape of the tip of the bore drilling tool (not shown).

Referring also to FIG.,s 3A and 3B, plug valve 10 includes a slidable member 34, which functions as a valve closure mechanism. Slidable member 34 includes a cylindrical pin 36 with an elongated slot 38 machined therein and a cap member 40 in concentric relationship with an end portion **36*a* of pin 36. Cap member 40 has knurled outer surface to provide a positive gripping surface for manual operation of slidable member 34. Slidable member 34 is manually operable, such that tools are not required to operate plug valve 10**.

Figure 5:
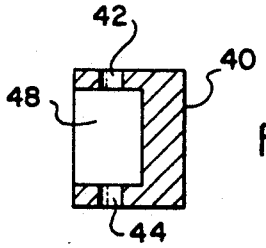
FIG. 5 is a side elevation view of a cap member adapted to fit on the slidable member of FIG. 3A.
Figure 6A:
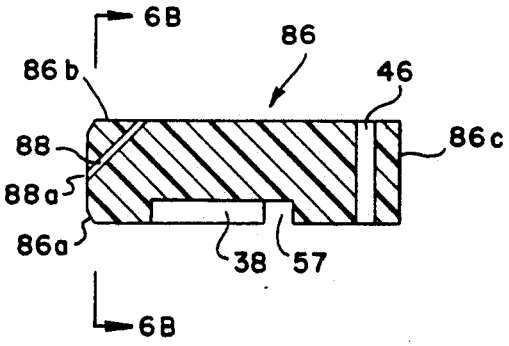
FIG. 6A is a longitudinal sectional view of an alternate embodiment of the slidable member.
Figure 6B:
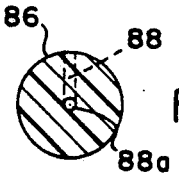
FIG. 6B is a sectional view of the slidable member of FIG. 6B, taken along the line 6B—6B of FIG. 6A.

Referring also to FIG. 5, cap member 40 has two openings 42 and 44, which are alignable with a bore 46 formed in end portion **36*a*. Bore 46 extends transversely with respect to a longitudinal axis of pin 36. Cap member 40 further includes a recess 48 adapted to receive end portion 36*a* in snug fit mating relationship, as shown in FIG.'s 1A and 1C. End 36*a* is received in recess 48, such that openings 42 and 44 are in transverse axial alignment with bore 46. A retaining pin 50 is press fit through opening 42, bore 46 and opening 44 to provide a positive attachment of cap 40 to pin 36**.

Figure 1B:
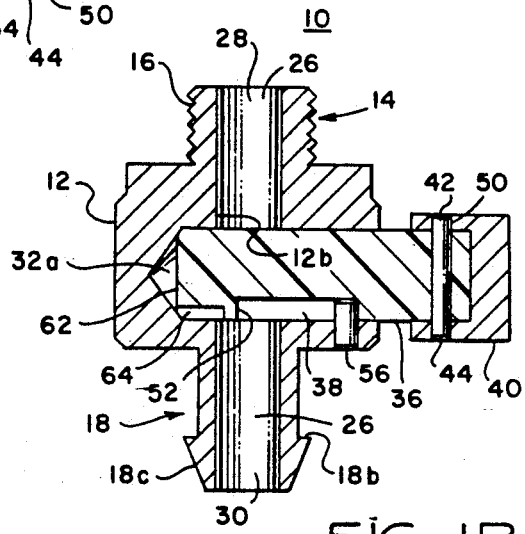
Figure 1C:
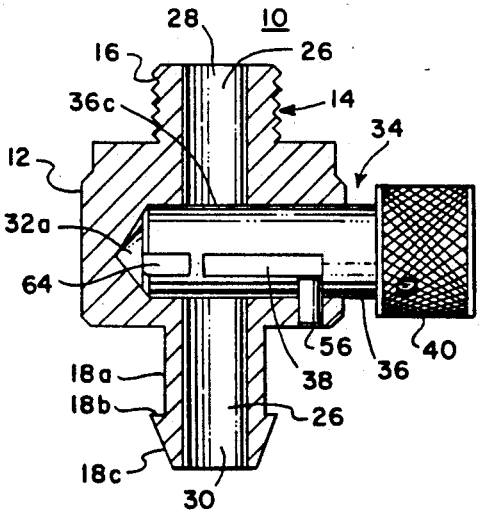

The machining of slot 38 defines shoulders 52 and 54 at respective opposite ends of slot 38. Valve body 12 includes a locator pin 56, which extends into slot 38, as can be best seen in FIG.'s 1A and 1B. Pin 56 is engageable with shoulders 52 and 54 to limit the reciprocating movement of slidable member 34 in each direction. In FIG. 1A, slidable member 34 is shown fully retracted, such that bore 26 is completely unobstructed, to allow oil to drain from oil pan 22 through bore 26. In this position, locator pin 56 is in contact with shoulder 52, to limit further retraction of slidable member 34. In FIG. 1B, slidable member 34 has been moved to a closed position, to substantially completely block bore 26 and prevent the flow of oil between inlet and outlet ports 28 and 30. In this position, locator pin 56 is in contact with shoulder 54 to limit further inward movement of slidable member 34. Locator pin 56 therefore cooperates with slot 38 to guide pin 36 in its reciprocating movement and to define the limits of movement of pin 36. Locator pin 56 is preferably press fit into valve body 12.

Figure 3A:
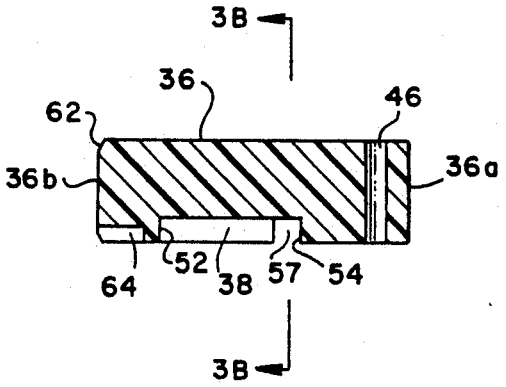
FIG. 3A is a longitudinal sectional view of a slidable member of the drain valves shown in FIG.'s 1A-1C and FIG. 2.
Figure 3B:
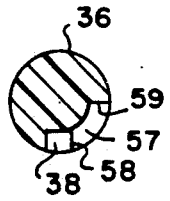
FIG. 3B is a sectional view, taken along the line 3B—3B of FIG. 3A.

An arcuate groove 57 communicates with slot 38 to define a shoulder 58, as can be best seen in FIG. 3B. Groove 57 is oriented transversely with respect to the longitudinal axis of slot 38. When slidable member 34 is the closed position as shown in FIG. 1B, locator pin 56 is positioned between shoulders 54 and 58 and is aligned with groove 57. When pin 36 is rotated clockwise (as viewed from cap member 40), locator pin 56 is urged into groove 57, such that slidable member 34 is substantially "locked" in the closed position. Groove 57 terminates at a shoulder 59, which limits the clockwise rotation of pin 36. In order to move slidable member 34 to the open position shown in FIG. 1A, slidable member 34 is rotated counterclockwise (as viewed from cap member 40) to disengage pin 56 from groove 57. Pin 36 is retractable to the open position shown in FIG. 1A to restore fluid communication between inlet and outlet port 28 and 30.

Leading end 36*b* of pin 36 is slightly tapered, as indicated at 62, to facilitate the insertion of pin 36 into bore 32. Alternatively or in addition to leading end 36*b* being tapered, an inlet port 32*b* of bore 32 is slightly tapered to urge pin 36 into bore 32. Tapered portion 62 is machined around the entire circumference of pin 36, adjacent leading end 36*b*, to provide a relief for the installation and compression of pin 36.

Another slot 64 is machined in pin 36. Slot 64 extends from leading end 36*b* partially to slot 38. Slot 64 communicates with bore 26 when slidable member 34 is in the closed position to provide relief for fluid trapped in constricted portion 32*a* when slidable member 34 is in the closed position shown in FIG.,s 1B and 1C. Although slot 64 has substantially the same depth, width and plane alignment as slot 38, slot 64 does not communicate with slot 38.

Nipple member 18 includes a cylindrical portion 18*a*, which is machined to define a annular shoulder 18*b*. End portion 18*c* of nipple 18 is tapered, such that end portion 18*c* is adapted to be inserted into a conduit, such as flexible tube (not shown), for conducting the oil drained from oil pan 22 through bore 26 to a remote location, such as a portable container (not shown). End portion 18*c* facilitates the insertion of nipple 18 into a flexible conduit.

In accordance with the present invention, pin 36 is a substantially cylindrical pin formed of a resilient composite material, such as virgin polytetrafluoroethylene. One example of virgin polytetrafluoroethylene is the resilient material sold under the trademark "Teflon" by duPont de Nemours. The resilient material used preferably has the desired characteristics of corrosion resistance, thermal stability over a wide range of temperatures (preferably temperatures to which automobile engine lubricating oil is subjected), self-lubrication and mechanical strength. The material is also electrically and thermally nonconductive. To provide a positive seal between pin 36 and an inner surface 12*a* of valve body which defines bore 32, pin 36 has a greater diameter than the diameter of bore 32. The diameter of pin 36 can range from 0.0001 to 0.1 inch greater than the diameter of bore 32 and is preferably approximately 0.005 inch greater than the diameter of bore 32. The compressibility of pin 36 results in a snug fit within bore 32, which provides a positive seal under widely varying temperatures and pressures, while allowing pin 36 to be movable under such widely varying temperatures and pressures. A portion 36*c* of pin 36 which blocks bore 26 when slidable member 34 is in the closed position, as shown in FIG.'s 1B and 1C, expands slightly into bore 26, to provide a positive seal between pin member 36 and an inner surface 12*b* of valve body 12 which defines bore 26. The positive seal is maintained along substantially the entire length of pin member 36 As such, it is not necessary to machine a dedicated valve seat within bore 32 or an enlarged sealing ring or the like on pin member 36 in order to provide an effective seal.

According to prior practice, a conventional valve stem and seat are used to provide a seal at only one location within a valve bore. As the valve stem and/or seat become worn due to pressure, corrosion and continued operation, leakage is likely to result. In accordance with the present invention, however, a positive seal is maintained substantially along the entire length of pin member 36, which substantially reduces the likelihood of leakage because sealing pressure is not brought to bear at a single location. The corrosion resistance and thermal stability of the material comprising pin 36 also substantially reduce the likelihood of leakage and other problems likely to cause failure or unreliability of the valve mechanism. The positive seal between pin member 36 and inner surfaces 12*a* and 12*b* of valve body 12 is also substantially resistant to impact forces and vibration. As such, the plug valve according to the present invention is substantially less likely to become disengaged accidentally than conventional plug valves. The thermal stability characteristic of the material comprising pin 36 provides consistent compressibility and expandability of the material throughout a wide range of operating temperatures, such that a positive seal is maintained regardless of the temperature of the oil to which pin 36 is exposed. The self-lubricating characteristics of pin 36 render pin 36 substantially resistant to mechanical wear, despite repetitive operation. It has been discovered that in order to provide effective sealing, the diameter of bore 26 should be no greater than 80% of the diameter of bore 32.

Referring to FIG.'s 2 and 4, an alternate embodiment of a plug valve 70, according to the present invention, is shown. Valve 70 has a 90° configuration, as opposed to the 180° configuration of valve 10, described above with reference to FIG.'s 1A–1C. Valve 70 has substantially identical dimensions to valve 10. Valve body 72 of valve 70 has an outlet port 74, which is oriented at a 90° angle with respect to inlet port 76. Valve 70 also differs from valve 10 in that valve 70 includes a nipple 78 which is press fit into valve body 72 rather than being integrally formed therewith. Alternatively, nipple 78 can be machined with external threads and valve body 72 machined with internal threads, such that the interconnection of the respective threads joins nipple 78 to valve body 72. A plug member 73 is machined in relief from valve body 72 with external threads 75.

Figure 4:
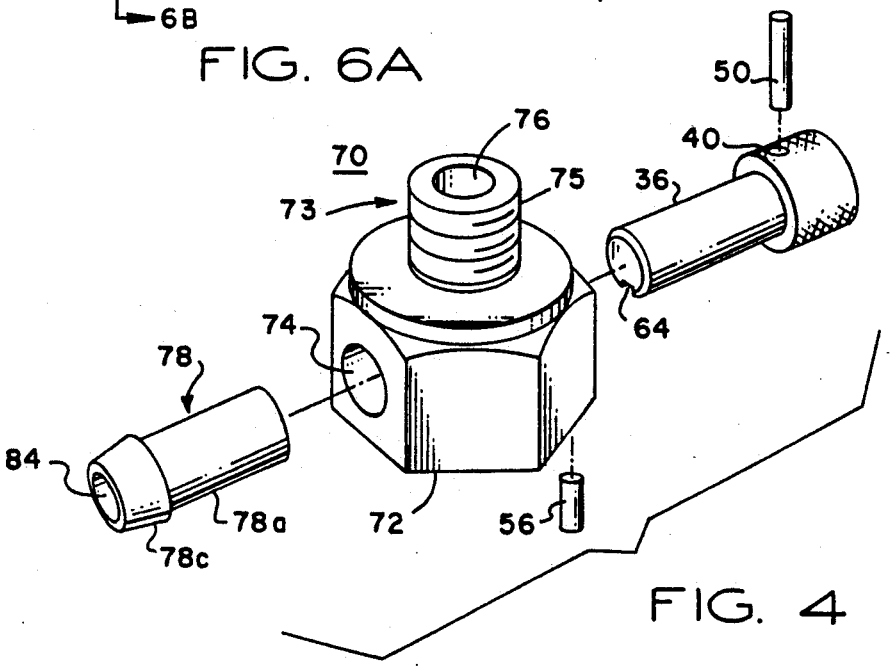
FIG. 4 is an exploded perspective view of the drain valve of FIG. 2.

As can be best seen in FIG. 4, valve body 72 is machined from hexagon metal bar stock, such as aluminum or brass bar stock. Nipple 78 includes a cylindrical portion 78*a*, which is machined to define an annular shoulder 78*b*. The end portion 78*c* of nipple 78 is tapered to facilitate the insertion of nipple 78 into a flexible conduit or the like (not shown).

Inlet port 76 communicates with an internal bore 80 within valve body 72. Another bore 82 intersects bore 80 at right angles. Bore 82 is adapted to receive pin 36. Pin 36 is mountable for reciprocating movement within bore 82, as previously described with reference to FIG.'s 1A–1C. Bore 80 communicates between inlet port 76 and bore 82. Bore 82 communicates between bore 80 and outlet port 74. Outlet port 74 further communicates with internal passageway 84 of nipple 78.

Figure 2:
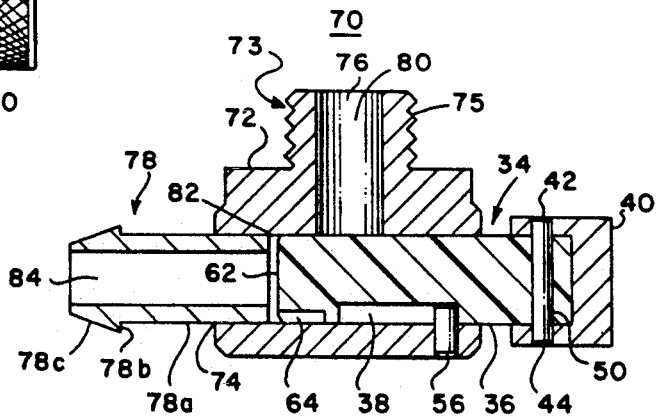
FIG. 2 is a longitudinal sectional view of an alternate embodiment of a drain valve, according to the present invention, showing the valve in a closed position.

Slidable member 34 is shown in the closed position in FIG. 2. In this position, communication between bores 80 and 82 is effectively blocked by pin 36. Slidable member 34 is moved to the open position by retracting pin 36 back through bore 82, to restore fluid communication between bores 80 and 82.

Referring to FIG.'s 6A and 6B, an alternate embodiment of a slidable pin 86 is depicted. Pin 86 is substantially the same as pin 36, described above with reference to FIG.'s 1A–1C, 3A and 3B, except that slot 64 has been replaced by a cylindrical passage 88, which extends from a small weep hole 88*a* at the center of leading end 86*a*, diagonally through cylindrical outer wall 86*b* of pin 86 and communicates with the fluid drain bore (not shown) of the valve mechanism. Passage 88 relieves fluid trapped in the pin receiving bore (not shown) into the fluid drain bore when the valve mechanism is in the closed position. Trailing end 86c is adapted for mating engagement with a corresponding cap member (not shown), as previously described.

In accordance with the present invention, an improved drain valve is provided which is suitable for use as an automobile oil pan plug valve. The valve is manually operable without tools and facilitates the oil change procedure by substantially eliminating the mess, inconvenience and hazards typically associated with changing engine lubricating oil. The valve mechanism is substantially resistant to leakage throughout a wide range of temperatures and pressures and is not susceptible to accidental operation due to impact forces and vibration.

The preferred embodiment of the invention has now been described in detail. Since it is obvious that many changes in and additions to the above-described preferred embodiment may be made without departing from the nature, spirit and scope of the invention, the invention is not to be limited to the disclosed details, except as set forth in the appended claims.

We claim:

1. A fluid drain valve, comprising:

a valve body having an inlet port through which fluid is admitted into said valve body and an outlet port through which fluid is drained from said valve body;

substantially cylindrical first and second bores extending at least partially through said valve body, said second bore intersecting said first bore at essentially a right angle;

a substantially cylindrical slidable member mounted for reciprocating movement in said second bore between a first position at which said inlet and outlet ports are in fluid communication and a second position at which fluid communication between said inlet and outlet ports is substantially blocked, said slidable member having a somewhat greater diameter than the diameter of said second bore, said slidable member being comprised of a resilient material which is radially compressible to allow said slidable member to be inserted into said second bore and is expandable within said second bore to tightly and positively seal said second bore along substantially the entire length of said slidable member;

guide means for guiding the reciprocating movement of said slidable member, said guide means including a first guide member mounted with said valve body and a second guide member carried on said slidable member for aligning said slidable member for insertion within said second bore, said first guide member being engageable with said second guide member to define said first and second positions; and retaining means cooperative with said guide means for retaining said slidable member in said second position when said slidable member is rotated.

2. The drain valve of claim 1 wherein the resiliency of said material is stable throughout a predetermined range of temperatures.

3. The drain valve of claim 2 wherein said predetermined range of temperatures corresponds to a range of temperatures to which automobile engine lubricating oil is normally subjected.

4. The drain valve of claim 1 wherein said material is substantially corrosion resistant.

5. The drain valve of claim 1 wherein said material is self-lubricating.

6. The drain valve of claim 1 wherein said material is virgin polytetrafluoroethylene.

7. The drain valve of claim 1 wherein said first bore extends between said inlet and outlet ports, said second bore passing transversely through said first bore and terminating within said valve body, said slidable member further including a passage communicating between a leading end of slidable member and said first bore when said slidable member is in said second position to relieve fluid from said second bore into said first bore.

8. The drain valve of claim 7 further including a slot extending from said leading end, partially along a longitudinal axis of said slidable member, said slot providing a passage to relieve fluid from said second bore into said first bore when said slidable member is in said second position.

9. The drain valve of claim 7 further including a passage extending from a leading end of said slidable member, diagonally through a portion of said slidable member, to relieve fluid from said second bore into said first bore when slidable member is in said second position.

10. The drain valve of claim 1 wherein said first bore extends between said inlet port and said second bore, said second bore extending completely through said valve body and communicating with said outlet port.

11. The drain valve of claim 1 wherein said second guide member includes a slot extending along a longitudinal axis of said slidable member, said slot defining first and second shoulders at respective opposed ends of said slot, said first guide member including a guide pin, said guide pin normally being in mating relationship with said slot for guiding the reciprocating movement of said slidable member, said guide pin being engageable with said first and second shoulders to define said first and second positions.

12. The drain valve of claim 11 wherein said retaining means includes an arcuate groove communicating with said slot and extending transversely with respect to said longitudinal axis, said guide pin being engageable with said groove when said slidable member is in said second position, said guide pin being captured within said groove by rotating said slidable member about its own axis to retain said slidable member in said second position.

13. The drain valve of claim 1 wherein said slidable member includes a substantially cylindrical pin and a substantially cylindrical cap having a recess adapted to receive a trailing end of said pin in mating relationship, said cap providing a gripping surface for manual operation of said slidable member.

14. The drain valve of claim 1 wherein a leading end of said slidable member is tapered to provide relief for compression of said slidable member.

15. The drain valve of claim 1 wherein said drain valve is a plug valve adapted for use in an automobile oil pan drain port, said valve including a plug member machined in relief from said valve body, said plug member having external screw threads adapted to engage complementary internal screw threads in the oil pan drain port, said inlet port being formed in said plug member.

16. The drain valve of claim 15 further including a nipple member machined in relief from said valve body on an opposite end of said valve body from said plug member, said outlet port being formed in said nipple member, said nipple member being adapted to be received in mating relationship with a conduit for conducting oil drained through said outlet port to a selected location.

17. The drain valve of claim 1 wherein the diameter of said first bore is no greater than 80% of the diameter of said second bore.

18. A fluid drain valve, comprising:

a valve body having an inlet port through which fluid is admitted into said valve body and an outlet port through which fluid is drained from said valve body;

first and second bores extending at least partially through said valve body, said second bore intersecting said first bore at essentially a right angle;

a slidable member mounted for reciprocating movement in said second bore between a first position at which said inlet and outlet ports are in fluid communication and a second position at which fluid communication between said inlet and outlet ports is substantially blocked, said slidable member being compressible to allow said slidable member to be inserted into said second bore and being expandable within said second bore to tightly and positively seal said second bore along substantially the entire length of said slidable member;

guide means for guiding the reciprocating movement of said slidable member for aligning said slidable member for insertion within said second bore, said guide means including a first guide member mounted with said valve body and a second guide member carried on said slidable member, said first guide member being engageable with said second guide member to define said first and second positions; and retaining means cooperative with said guide means for retaining said slidable member in said second position when said slidable member is rotated.

19. The drain valve of claim 18 wherein said slidable member is further expandable into a portion of said first bore adjacent an intersection of said second bore with said first bore, to provide a positive seal between said slidable member and an inner surface of said valve body defining said first bore. into said second bore and being expandable within said second bore to tightly and positively seal said second bore along substantially the entire length of said slidable member;

guide means for guiding the reciprocating movement of said slidable member, said guide means including a first guide member mounted with said valve body and a second guide member carried on said slidable member, said first guide member being engageable with said second guide member to define said first and second positions; and retaining means cooperative with said guide means for retaining said slidable member in said second position when said slidable member is rotated.

20. An oil plug valve, comprising:

a valve body;

a plug member machined in relief from said valve body, said plug member having external screw threads adapted to engage complementary internal screw threads in an automobile oil pan drain port;

an inlet port formed in said plug member for admitting oil from the drain pan into the valve body;

substantially cylindrical first and second bores extending at least partially through said valve body, said second bore intersecting said first bore at essentially a right angle;

a nipple member machined in relief from said valve body on an opposite end of said valve body from said plug member;

an outlet port formed in said nipple member, said nipple member being adapted to be received in mating relationship with a conduit for conducting oil drained through said outlet port to a selected location;

a substantially cylindrical slidable member mounted for reciprocating movement in said second bore between a first position at which said inlet and outlet ports are in fluid communication and a second position at which fluid communication between said inlet and outlet ports are substantially blocked, said slidable member having a somewhat greater diameter than the diameter of said second bore, said slidable member being comprised of a resilient material which is radially compressible to allow said slidable member to be inserted into said second bore and is expandable within said second bore to tightly and positively seal said second bore along substantially the entire length of said slidable member;

a slot formed in said slidable member and extending along a longitudinal axis of said slidable member, said slot defining first and second shoulders at respective opposed ends of said slot;

a guide pin projecting from said valve body, said guide pin being engageable with said slot for guiding the reciprocating movement of said slidable member for aligning said slidable member for insertion within said second bore, said guide pin being engageable with said first and second shoulders to define said first and second positions; and an arcuate groove communicating with said slot and extending transversely with respect to said longitudinal axis, said guide pin being received in said groove when said slidable member is in said second position, said guide pin being captured within said groove by rotating said slidable member about its own axis to retain said slidable member in said second position.

* * * * *